United States Patent [19]

Dobner et al.

[11] 4,073,252

[45] Feb. 14, 1978

[54] METHOD FOR EFFECTING THE SEWING OF A POCKET STITCH

[75] Inventors: Reinhold Dobner; Walter Hager, both of Kaiserslautern, Germany

[73] Assignee: Pfaff Industriemaschinen GmbH, Germany

[21] Appl. No.: 705,423

[22] Filed: July 15, 1976

Related U.S. Application Data

[62] Division of Ser. No. 638,184, Dec. 5, 1975, Pat. No. 3,983,825.

[30] Foreign Application Priority Data

Dec. 5, 1974 Germany ..... 2457534

[51] Int. Cl.[2] ..... D05B 3/12

[52] U.S. Cl. ..... 112/265

[58] Field of Search ..... 112/262, 265, 121.12, 112/121.11, 121.15, 158 R, 158 E, 73, 70, 102, 104, 113, 114

[56] References Cited

U.S. PATENT DOCUMENTS

| | | | |
|---|---|---|---|
| 349,358 | 9/1896 | Reece | 112/70 |
| 3,448,705 | 6/1969 | Scherr et al. | 112/102 X |
| 3,543,737 | 12/1970 | Maschmann | 112/102 X |
| 3,653,347 | 4/1972 | Bianchi | 112/121.12 |
| 3,930,454 | 1/1976 | Perlino | 112/121.12 |

*Primary Examiner*—H. Hampton Hunter
*Attorney, Agent, or Firm*—McGlew and Tuttle

[57] ABSTRACT

A pocket stitch is sewn on cut workpiece parts which are guided into operative association with a reciprocating needle which effects a straight stitch when it is reciprocated and also may be swung from side to side to effect a zig-zag stitching. The workpiece is guided so as to form at least one substantially U-shape straight stitch having spaced apart leg portions and the stitch is secured by guiding the workpiece to effect the formation of a barring stitch at the ends of each leg portion by causing the needle to form a zig-zag stitch at such location. The sewing machine for sewing the pocket cuts includes a needle bar which may be swung during the operation of the drive mechanism or the zig-zag control mechanism may be shifted to effect the formation of a straight stitch. A rotatable cam which is driven by the drive mechanism positions a clamping plate having a substantially U-shape slot which permits reciprocation of the needle through a workpiece carried thereon. The cam includes means for controlling the swinging of the needle to effect the zig-zag stitching and for controlling the straight stitching operation of the needle and it also has means for controlling the shifting of the workpiece to follow the outline. The device can also effect the formation of a double U-shaped stitch in which the U-shape portion is formed by two spaced apart straight stitches and a barring stitch is used at each end of the leg portions which is formed by a zig-zag stitch which is effected transversely to the straight stitches.

4 Claims, 7 Drawing Figures

METHOD FOR EFFECTING THE SEWING OF A POCKET STITCH

FIELD AND BACKGROUND OF THE INVENTION

This is a division of Ser. No. No. 638,184 filed Dec. 5, 1975 of U.S. Pat. No. 3,983,825 issued Oct. 5, 1976.

This invention relates in general to a method and apparatus for sewing workpieces and, in particular, to a new and useful sewing machine and to a method for sewing pocket cuts on cut part workpieces in which substantially U-shape straight stitches are formed which are provided with a barring seam at each leg end which is effected by a zig-zag stitching.

DESCRIPTION OF THE PRIOR ART

For sewing pocket cuts on peices of clothing, for example, breast pockets on shirts or smocks, it is well known to fold the pocket cut in a folding station preceding the sewing machine and to position the prepared pocket cut on the piece of clothing. Subsequently, the cut is tranferred, along with the piece of clothing, to a guide mechanism conveying the two parts through the stitch forming area of the sewing machine.

The known sewing machines used for this purpose are usually program-controlled sewing machines in which the guide mechanism performs a motion corresponding to the pattern of the stitching to be done which, for example, is predetermined by a template. Since, during use of the clothing, the two ends of the seam thus produced are exposed to very high stresses, it is necessary to secure both ends of the seam against loosening, by barring stitches. Hitherto, this was done so that the barring stitches securing the seam ends were produced in a separate machine, or in the same template sewing machine, but prior to or after forming the fastening seam proper.

Since the piece of clothing with the pocket cut sewn thereon must be fixed in position for a second time for producing the barring stitches, the first-named method is very time-consuming and, in the case of a mispositioning, leads to an inaccurate relative position between the fastening seam and the barring stitches and, thereby, to an unsightly appearance of the seam. In the second method, the necessary movements both for producing the fastening seam and for producing the barring stitches are executed by the guide mechanism. With this last-mentioned method, a quite satisfactory seam pattern can be obtained. However, since a rapid sequence of relatively small and mutually oppositely directed motions of the sewn pieces is necessary to produce the zig-zag barring stitches, correspondingly designed sewing machines can be operated at only a relatively low speed. For sewing pocket cuts on smocks, in most cases, in view of the expected strong stressing of the seam, a seam is formed substantially having the shape of a doubled U.

It is well known that the optimum securing of a seam is a barring seam laterally extending beyond the two seam lines to be connected. Up to date, in machines adapted to produce the barring seam in a single operation with the fastening seam proper, a barring seam is formed extending merely between the two seam line ends of the U-shape legs. The possibility of having the row of barring stitches extending at both sides beyond the seam line ends of the legs has hitherto been given only in cases where a separate forming of the fastening seam and the barring seam is provided.

SUMMARY OF THE INVENTION

The present invention is directed to a sewing machine comprising a guide mechanism making it possible, while avoiding transverse movements of the guide mechanism corresponding to the formation of the zig-zag seam, to produce the fastening same as well as a barring seam, which, in the zone of the seam line ends of the two doubled U legs, extends laterally beyond the two seam line ends and is reinforced at the same time, in a single operation.

With the use of a zig-zag machine, known per se, this problem is solved, in accordance with the invention, by providing that the cross-stitching or bight of the zig-zagging mechanism of the sewing machine is oriented in a direction parallel to the longitudinal extension of the doubled seam legs, the ends of which are to be connected to each other, and that, in the zone of each of the seam encs and while the zig-zagging mechanism is in operation, the guide mechanism is reversably movable transversely to the longitudinal direction of the seam legs.

Due to this mutual association of the motion of the guide mechanism and the orientation of the cross-stitches of the zig-zagging mechanism, a barring seam can be obtained which, in the zone extending laterally of the legs of the fastening seam and because of the reversal of the transverse motion of the guide mechanism, is formed, in practice, as a double-barring seam while the portion of the barring seam extending between the two seam lines of the seam legs is formed as a single barring seam. In this way, both the strength of the barring seam is adapted to the expected occurring stresses and a pleasing appearance of the entire seam pattern is obtained.

In accordance with a development of the invention, the barring seam reinforced in the zone of its two laterally over-extending ends can be produced in a manner which is simple from the point of view of the motion control and as a seam pattern which is closed in itself, if the transverse motion of the guide mechanism is divided into three phases of motion, of which the first phase of motion corresponding to the lateral over-extension of the barring seam is followed by a second phase of motion corresponding to the entire length of the barring seam and taking place in a direction opposite to the first phase of motion, and by a third phase of motion which, as to its extent and direction, is identical with the first phase of motion.

As a rule, in the sewing of breast pockets on front parts of shirts and because of the generally smaller stressing of the fastening seam, only a single U-shape seam is formed, the two ends of which are secured against loosening by a barring seam. Although here again, in principle, it would be possible to form a zig-zag barring seam either in a separate operation or by an additional motion of the guide mechanism corresponding to the zig-zag stitching, the industry has switched over, not least for reasons of economy, to the substitution of a so-called triangular barring seam for the zig-zag barring seam which, without any doubt, is preferable for reasons of strength. This triangular seam which can be produced in a single operation with the fastening seam and with which the starting and finishing ends of the seam are displaced into a less stressed zone, is substantially formed by a section extending perpendicularly to the two mutually parallel legs of the fastening seam and a section extending obliquely thereto. This kind of barring permits a more economic manufacture as compared to the use of a zig-zag barring seam, however, its strength is very limited.

For this reason, the invention is further directed to a sewing machine which, while avoiding transverse motions of the guide mechanism corresponding to a zig-zag seam, makes it possible to produce a zig-zag barring seam having its longitudinal axis parallel to the two legs of the U-shape fastening seam, in a single operation along with the fastening seam.

In accordance with the invention, and with the use of a zig-zag machine known per se, this problem is solved by providing that the cross-stitches of the zig-zagging mechanism are oriented perpendicularly to the direction of motion of the guide mechanism in which the two mutually parallel seam legs are formed. Due to this association of the direction of motion of the guide mechanism with the direction of the cross-stitching of the zig-zagging mechanism, the possibility is given, in a quite simple manner, to start the forming of one leg by first producing a zig-zag barring seam which, thereupon, continues as the leg of the fastening seam proper. Analogously, the end of the other leg of the fastening seam is directly terminated by a zig-zag barring seam having its longitudinal axis parallel to the longitudinal direction of the leg.

A favorable arrangement with respect to the insertion and feed of the pocket cuts and cut pieces is obtained if the motion of the guide mechanism for producing the two mutually parallel seam legs takes place parallel to the main shaft of the machine and the cross-stitches of the zig-zagging mechanism are oriented perpendicularly thereto.

Accordingly, it is an object of the invention to provide an improved sewing machine construction which includes a needle bar having a thread guide needle which is mounted for reciprocation and for back and forth swinging movement to effect the formation of straight stitching and zig-zag stitching and which includes a guide for the workpiece and a control for effecting the straight stitching formation of substantially U-shape to form a pocket stitch, and also for controlling the swinging of the needle so that a zig-zag stitch is made at each end of the U-shape to form a barring seam.

A further object of the invention is to provide a sewing machine which is capable of forming a zig-zag stitch transversely to a straight stitch and to form a barring stitch at each end of the continuous straight stitch.

A further object of the invention is to provide a method of effecting the sewing of a pocket stitch on a workpiece which is guided into operative association with a reciprocating needle which effects both a straight stitch and a zig-zag stitch and which comprises guiding the workpiece so as to form at least one substantially U-shape straight stitch having spaced apart leg portions and including securing the straight stitch at each end by guiding the workpiece to effect the formation of a barring at the end of the leg portions which may be effected either transversely to the straight stitch and in forward and reverse directions or as a continuation of the straight stitch on either side thereof.

A further object of the invention is to provide a sewing machine which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
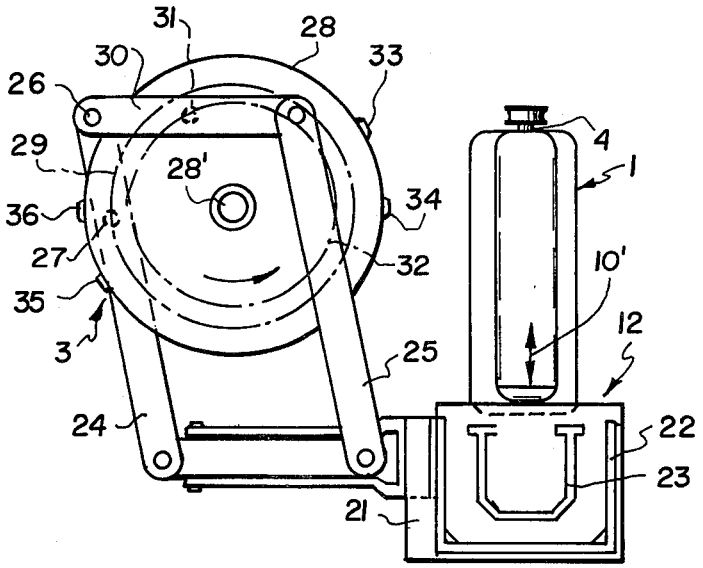
FIG. 1 is a top plan view of a first embodiment of a sewing machine having a guide mechanism and a work-clamping mechanism constructed in accordance with the invention.
Figure 2:
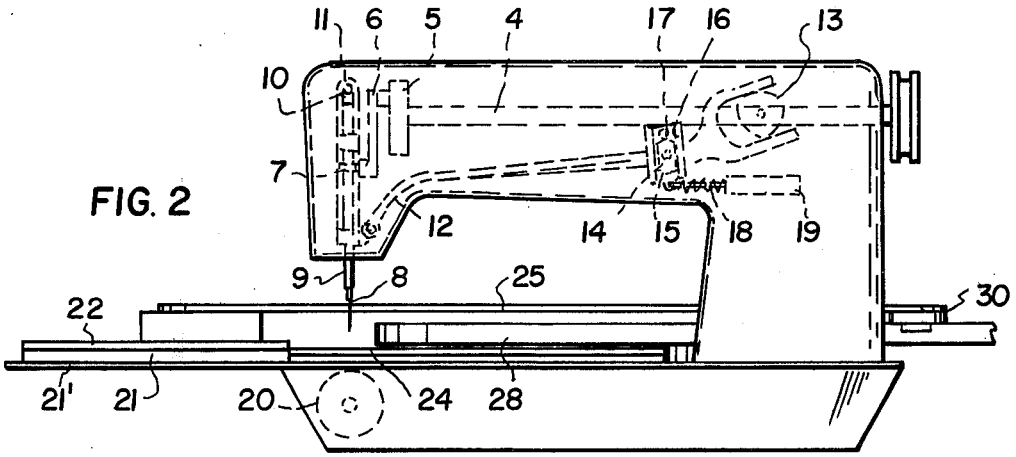
FIG. 2 is a front elevational view of the sewing machine shown in FIG. 1.

Referring to the drawings in particular, the invention embodied therein in FIGS. 1 through 3*a*, includes a sewing machine, generally designated 1, having a workpiece clamping mechanism, generally designated 2, which is moved under the control of a combined guide mechanism 3 for moving the workpiece clamping mechanism and for effecting the control of a straight and zig-zag stitch.

Sewing machine 1 is a zig-zag sewing machine which includes a main shaft 4 having a crank 5 at one end which is connected through a link 6 to an intermediate member 7. Intermediate member 7 is secured to a needle bar 9 carrying a guiding needle 8. Needle bar 9 is guided in an arm 10 which is oscillatable about a pivot pin 11 for oscillatable movement within the housing of sewing machine 1. Arm 10 is movable in a plane which is parallel to the plane of main shaft 4 and it is hinged at its lower end to an eccentric rod 12. Eccentric rod 12 engages an eccentric 13 which is driven from the main shaft 4 through a reduction gearing having a ratio of 2 : 1. Rod 12 includes a locating stud 14 for a slider 15 which is movable within a slideway 16. Slideway 16 is pivotable about a fixed pin 17 so that the magnitude of the cross-stitch of the zig-zagging mechanism is adjustable from zero to the maximum bight. For adjusting the slideway and thereby for varying the bight, the device includes a spring-loaded piston rod 18 which acts on the slideway and cooperates with an air cylinder 19 which is actuated by the control mechanism 3. Thread guiding needle 8 of the sewing machine cooperates with a double lock stitch rotary hook 20 which rotates in a plane which is parallel to the plane of the main shaft 4 of the machine.

In accordance with a feature of the invention, the workpiece clamping mechanism 2 which is intended for receiving the fabric or workpiece comprises a supporting plate 21 which is displaceable on a base plate 21' of sewing machine 1. Clamping plate 22 is pivotally mounted on base plate 21'. Both support plate 21 and clamping plate 22 are provided with a slot 23 which corresponds to the pattern of the seam to be produced and which enables the needle 8 to penetrate through the workpiece.

Support plate 21 of clamping mechanism 2 is connected to two links 24 and 25 of a parallel mechanism, generally designated 3, which comprises both a stitch control and a workpiece movement control. Link 24 is pivoted to a fixed pin 26 and carries a guide roller 27 which engages in a guide slot 29 which is provided on the underside of a control disc 28, as indicated in FIG. 1., and shown in a dash-dotted circle line. The second link 25 is hinged to an intermediate member 30 which is also pivoted to a pin 26. Intermediate member 30 carries a guide roller 31 which engages in a guide slot 32 provided on the upper side of a control disc 28 and also indicated in a dash-dotted circle line in FIG. 1 for purposes of simplifying the drawing. Disc 28 is driven from a shaft 28' of a motor (not shown) which is advantageously a separate motor from the drive of the sewing machine. This causes a pivoting of the two links 24 and 25 about pin 26 to produce a motion composed of two components and corresponding to the configuration of the seam to be produced and which corresponds to the outline of the slot 23 on the clamping plate 22.

The control disc 28 is provided with a plurality of actuating cams 33, 34, 35 and 36 which control the action of the air cylinder 19 which acts on slideway 16 of the zig-zagging mechanism.

During formation of the outer seam leg of the stitch seam having its starting end at point I (see FIG. 3), piston rod 18 of air cylinder 19 is in its rest position. Thereby, bight zero is adjusted on the zig-zagging mechanism and, during formation of the outer seam, the zig-zag sewing machine operates as a pure straight-stitch sewing machine.

As soon as point II of the seam is reached, air cylinder 19 is actuated by cam 33, whereby, slideway 16 is pivoted and a bight of a definite magnitude is adjusted. The two guide slots 29 and 32 of control disc 28 are designed, in their zones now to be followed by guide rollers 27, 31, so as to move work clamping mechanism 2 in a direction which is perpendicular to the extension of the outer seam leg, i.e., in FIG. 3, to the lefthand side. During this motion of the work to the left, needle bar 9 oscillates in a plane which is parallel to main shaft 4 and, thus, parallel to the two seam legs, so that the barring-seam portion *a* is formed in the direction of the arrow A.

Figure 3:
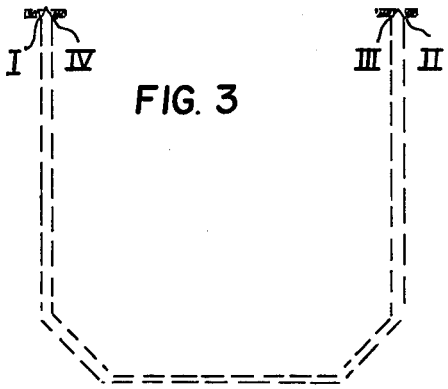
FIG. 3 is a plan view of a pocket stitch formation effected by the sewing machine.

At the end of barring-seam portion *a*, with an unchanged adjustment of the zig-zagging mechanism, the direction of motion of the work clamping mechanism is reversed, due to the corresponding design of guide slots 29, 32 of control disc 28, so that during the travel of work clamping mechanism 2, now to the right, as viewed in FIG. 3, barring-seam portion *b* is formed in the direction of arrow B. At the end of barring-seam portion *b*, the direction of motion of work clamping mechanism 2 is again reversed and, during the travel of the work clamping mechanism, now moving again to the left, barring-seam portion *c* is formed in the direction of arrow C.

Since during formation of the three barring-seam portions *a*, *b* and *c*, work clamping mechanism 2 is moved only transversely to the two legs of the U-shape seam and, during this transverse motion of the work clamping mechanism 2, needle bar 9 of sewing machine 1 performs a zig-zag motion in the directions indicated by the double arrow 101 in FIG. 1, barring-seam portions *a*, *b* and *c* become superposed. This results in the particular advantage that the transverse movements of the work clamping mechanism necessary for producing the barring seam virtually form a continuous line closed in itself and, after accomplishing barring-seam portion *c*, as from point III, the inner U-shape seam can be produced up to point IV.

For this purpose, air cylinder 19 is vented by actuating cam 34 so that slideway 16 returns into its neutral position and sewing machine 1 again produces a pure straight-stitch seam between the two ends III and IV.

In the position of control disc 28, corresponding to point IV, air cylinder 19 is again actuated by cam 35, whereby, sewing machine 1 is again switched to zig-zag stitching. In accordance with the design of the two guide slots 29, 32, work clamping mechanism 2 first moves to the left, transversely to the seam legs, whereby, starting from point IV, barring-seam portion *a* is formed in the direction of arrow A. At the end of barring-seam portion *a*, the direction of travel of the work clamping mechanism is reversed to the right, as viewed in FIG. 3, while the zig-zag adjustment of the sewing machine is maintained, so that barring-seam portion *b* is formed in the direction of arrow B. At the end of barring-seam portion *b*, the direction of motion of the work clamping mechanism is reversed again and, thereupon, barring-seam portion *c* is formed in the direction of arrow C. Thus, as may be seen in FIG. 3, each of the barring seams, produced in a virtually continuous line of stitches, has the total length *b* and extends laterally beyond the fastening seam at both sides, by a mutually equal length, *a* and *c*. Since, as already mentioned above, during the formation of the barring seam, the work clamping mechanism performs only a motion directed transversely to the fastening-seam legs and superposed by the cross-stitching motion of the needle which, in practice, is parallel to the longitudinal direction of the seam legs, barring-seam portions *a* and *b*, or *b* and *c*, are formed one on the other so that the barring-seam portions extending laterally of the respective fastening seam form substantially a double-barring seam.

Figure 6:
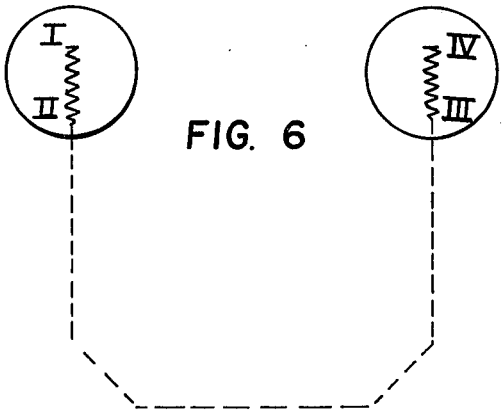
FIG. 6 is a plan view of another embodiment of stitch formation.
Figure 5:
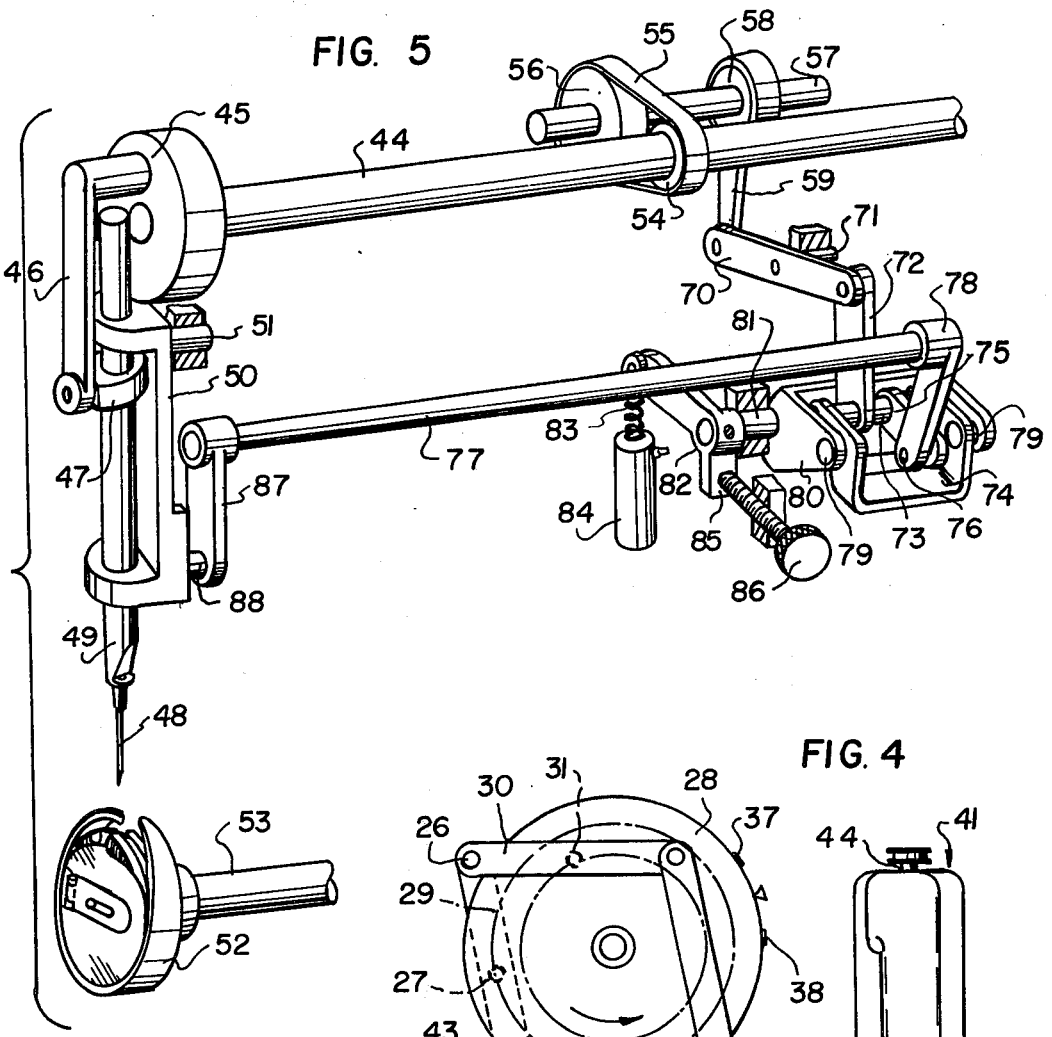
FIG. 5 is a perspective view of the zig-zag mechanism for the sewing machine of FIG. 4.
Figure 4:
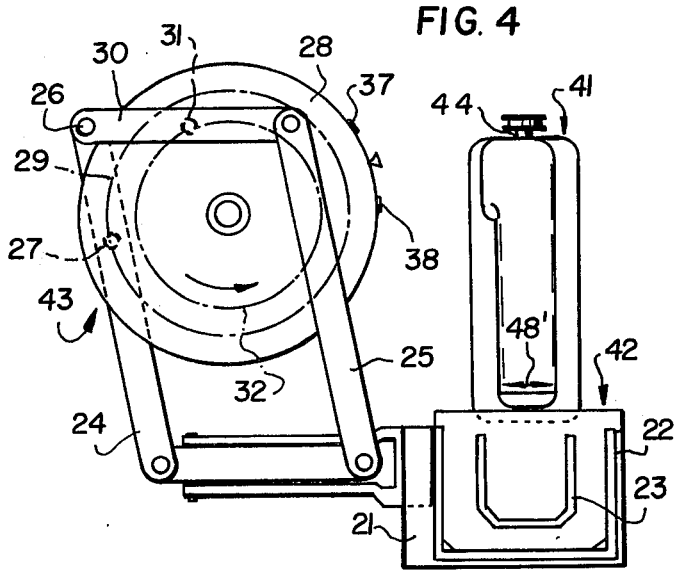
FIG. 4 is a top plan view of another embodiment of sewing machine.
Figure 3A:
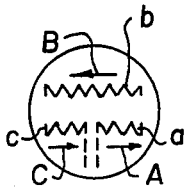
FIG. 3*a* is a detail of the end formation of each end of the stitch formation shown in FIG. 3.

In the second embodiment of the invention, shown in FIGS. 4 to 6, sewing machine 41 is also associated with a work clamping mechanism 42 and a guide mechanism 43. The main shaft 44 of sewing machine 41 (FIG. 5) carries a crank 45 secured thereto which is connected, through a link 46 and an intermediate member 47, to a needle bar 49 carrying a thread-guiding needle 48. Needle bar 49 is guided in an oscillatable arm 50 which, in turn, is pivotally mounted in the housing of the sewing machine, by means of a pin 51 which is provided at the upper end of arm 50 and extends parallel to main shaft 44 of the machine. Thread-guiding needle 48 cooperates with a double-lockstitch rotary hook 52 which is designed in a well known manner and driven by a shaft 53 extending parallel to main shaft 44 and connected thereto through a drive transmission of well known design (not shown).

To obtain the zig-zag cross-stich motion of needle bar 49, a belt pulley 54 is secured to main shaft 44 and is operationally connected, through a belt 55, to an associated pulley 56. Associated pulley 56 is secured to an intermediate shaft 57 which is parallel to main shaft 44 and is driven, through the mentioned drive transmission, by the main shaft at a reduced transmission ratio of 2 : 1. Intermediate shaft 57 carries an eccentric 58 over which an eccentric rod 59 is engaged having its free end hinged to an intermediate lever 70. Intermediate lever 70, which is mounted in the housing of the sewing machine by means of a pin 71, is connected to a link 72 whose free end engages over a pin 73 which is supported by two lateral webs of a bracket 74. Pin 73 further acts on a link 75 which is hinged, by means of a pin 76, to a crank 78 carried by an upper rock shaft 77.

Bracket 74 is pivotally mounted, by means of two mutually aligned hinge pins 79, on an adjusting member 80 which is provided with a stub shaft 81 and, in turn, pivotally mounted on the housing of the sewing machine. The position of member 80 or stub shaft 81 is adjusted by a two-armed lever 82 which is secured to the stub shaft 81. One end of lever 82 is connected to a spring-loaded piston rod 83 of an air cylinder 84 and the other end of lever 82 cooperates, as a stop piece 85, with an adjustable stop 86 which is provided in the housing of sewing machine 41.

A crank 87 which is secured to the front end of rock shaft 77 is connected, through a pin 88, to vibrating arm 50 of the needle bar. Thereby, vibrating arm 50, driven by rock shaft 77, performs oscillating motions in a plane which is perpendicular to the main shaft of the machine and which enables neecle 48 to execute zig-zag motions in the directions of the double-arrow 48', shown in FIG. 4.

The construction of work clamping mechanism 42 is substantially identical with that of work clamping mechanism 2. The sole difference is the shape of slot 23 which conforms to the shape of the seam to be produced.

The design of guide mechanism 43 also corresponds to that of guide mechanism 3. Only the two guide slots 29, 32 are adapted to the configuration of the seam to be produced, and instead of actuating cams 33, 34, 35 and 36, actuating cams 37 and 38 are provided, which also serve to control the operation of air cylinder 84.

For an explanation of the operation of the second embodiment of the invention, it is assumed that the U-shape seam shown in FIG. 6 is to be produced and secured in the zone of its two ends by a zig-zag barring seam extending at each end of the fastening seam in a direction parallel thereto.

In forming the zig-zag barring seam, while starting from point I, the two guide slots 29, 32 of control disc 28 driven by a motor (not shown) impart a motion to work clamping mechanism 42, which motion is parallel to main shaft 44 of the machine. At this time, air cylinder 84 is actuated so that stop piece 85 of adjusting member 80 applies against adjustable stop 86. Since in this position, the axis of pin 76 is not aligned with the axis of hinge pins 79, a bight of a definite magnitude is adjusted. Further, since vibrating arm 50 of the needle bar oscillates in a plane which is perpendicular to main shaft 44 and, thereby, to the feed direction of the work, i.e., oscillates in the direction of the arrow in FIG. 4, a zig-zag barring seam is formed because the zig-zagging mechanism and the work clamping or feeding mechanism operate simultaneously.

As soon as point II of the seam is reached, air cylinder 84 is vented by the action of cam 38. The spring surrounding piston rod 83 is relieved and returns piston rod 83 into the initial position thereof. Stop piece 85 moves away from stop 86 and causes a pivoting of adjusting member 80 into a position in which the axis of pin 76 is aligned with the axis of hinge pins 79. Thereby, a zero bight is adjusted in the zig-zagging mechanism so that, between points II and III, the sewing machine works as a straight-stitch machine and forms the substantially U-shape seam connecting points II and III. Upon reaching point III of the seam, air cylinder 84 is again actuated by cam 37 whereby stop piece 85 is brought into contact with stop 86. Consequently, adjusting member 80 comes into a position in which the axis of pin 76 is no longer aligned with the axis of hinge pins 79. Thereby, a bight of a predetermined magnitude is again adjusted in the zig-zagging mechanism and a zig-zag barring seam is produced again, this time between points III and IV. At end IV of the zig-zag barring seam, the zone of control disc 28 extending between cams 37 and 38 up to the marking is traced so that no switching of the zig-zagging mechanism is necessary between the formation of the finishing-end barring seam of the first seam and the formation of the starting barring seam of a second seam.

While specific embodiments of the invention have been shown and described in detail to illustrate the application of the principles of the invention, it will be understood that the invention may be embodied otherwise without departing from such principles.

What is claimed is:

1. A method of effecting the sewing of a pocket piece on a workpiece which is guided by a separately driven guide into operative association with a reciprocating needle of a sewing machine operative independently of the guide and which effects both a straight stitch when it is reciprocated and a zig zag stitch when it is swung backwardly and forwardly, comprising guiding the workpiece so as to form at least one substantially U-shaped straight stitch having spaced apart leg portions, and securing the straight stitch by guiding the workpiece to effect the formation of a barring stitch at the end of each leg portion of the straight stitch while moving the needle in a swinging motion to effect the formation of a zig zag stitch and in a manner to cause the starting and finishing ends of the bars to be located substantially in the center of the bar.

2. A method according to claim 1, wherein the needle is swung at each end of each leg portion in transverse back and forward directions to effect the zig-zag stitching.

3. A method of effecting the sewing of a pocket piece on a workpiece which is guided into operative association with a reciprocating needle which effects both a straight stitch when it is reciprocated and a zig-zag stitch when it is swung backwardly and forwardly, comprising guiding the workpiece so as to form at least one substantially U-shaped straight stitch having spaced apart leg portions, and securing the straight stitch by guiding the workpiece to effect the formation of a barring stitch at the end of each leg portion of the straight stitch while moving the needle in a swinging motion to effect the formation of a zig-zag stitch, the needle being swung backwardly and forwardly in directions parallel to the straight stitching while the workpiece is moved transversely backwardly and forwardly in respect to the formed straight stitching of the leg portions.

4. A method according to claim 3, wherein the transverse motion of the workpiece is subdivided into three periods of motion including a first period of motion to produce a lateral overlength stitch in one direction, a second period of motion carried out in an opposite direction to provide a total lateral stitch length substantially twice the length of the transverse stitch length of the first motion, and a third period of motion in which the length and direction is identical to the first motion.

* * * * *